US008080318B2

(12) United States Patent
De Jong et al.

(10) Patent No.: US 8,080,318 B2
(45) Date of Patent: Dec. 20, 2011

(54) SELF-HEALING FUSER AND FIXING MEMBERS

(75) Inventors: Kathy L. De Jong, London (CA); Nan-Xing Hu, Oakville (CA); Giuseppa Baranyi, Mississauga (CA); Barkev Keoshkerian, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 957 days.

(21) Appl. No.: 12/044,654

(22) Filed: Mar. 7, 2008

(65) Prior Publication Data

US 2009/0226228 A1 Sep. 10, 2009

(51) Int. Cl.
*G03G 15/20* (2006.01)

(52) U.S. Cl. ... 428/421; 399/122; 399/333; 428/402.21; 428/447; 523/200

(58) Field of Classification Search ..... 523/200, 523/205

See application file for complete search history.

(56) References Cited

U.S. PATENT DOCUMENTS

| | | | | |
|---|---|---|---|---|
| 4,257,699 | A | 3/1981 | Lentz | |
| 4,264,181 | A | 4/1981 | Lentz et al. | |
| 4,272,179 | A | 6/1981 | Seanor | |
| 4,373,239 | A | 2/1983 | Henry et al. | |
| 4,515,884 | A | 5/1985 | Field et al. | |
| 4,613,641 | A * | 9/1986 | Haubennestel et al. | 524/267 |
| 4,968,766 | A | 11/1990 | Kendziorski | |
| 5,017,432 | A | 5/1991 | Eddy et al. | |
| 5,049,444 | A | 9/1991 | Bingham et al. | |
| 5,061,965 | A | 10/1991 | Ferguson et al. | |
| 5,157,445 | A * | 10/1992 | Shoji et al. | 399/325 |
| 5,166,031 | A | 11/1992 | Badesha et al. | |
| 5,281,506 | A | 1/1994 | Badesha et al. | |
| 5,332,641 | A | 7/1994 | Finn et al. | |
| 5,366,772 | A | 11/1994 | Badesha et al. | |
| 5,370,931 | A | 12/1994 | Fratangelo et al. | |
| 5,401,570 | A | 3/1995 | Heeks et al. | |
| 5,409,557 | A | 4/1995 | Mammino et al. | |
| 5,463,009 | A | 10/1995 | Okada et al. | |
| 5,501,881 | A | 3/1996 | Fuller et al. | |
| 5,512,409 | A | 4/1996 | Henry et al. | |
| 5,516,361 | A | 5/1996 | Chow et al. | |
| 5,568,239 | A | 10/1996 | Furukawa et al. | |
| 5,624,780 | A | 4/1997 | Nishimori et al. | |
| 5,627,000 | A | 5/1997 | Yamazaki et al. | |
| 5,636,012 | A | 6/1997 | Uneme et al. | |
| 5,641,603 | A | 6/1997 | Yamazaki et al. | |
| 5,679,463 | A | 10/1997 | Visser et al. | |
| 5,698,320 | A | 12/1997 | Ebisu et al. | |
| 5,716,747 | A | 2/1998 | Uneme et al. | |
| 5,729,813 | A | 3/1998 | Eddy et al. | |
| 5,757,214 | A | 5/1998 | Stoddard et al. | |

(Continued)

OTHER PUBLICATIONS

Jerschow, Silicone Elastomers, 2002, Rapa review reports, Report 137, vol. 12, No. 5, p. 49.*

(Continued)

*Primary Examiner* — Jennifer McNeil
*Assistant Examiner* — Patrick English
(74) *Attorney, Agent, or Firm* — Oliff & Berridge, PLC

(57) ABSTRACT

An image fixing member includes a substrate; an optional intermediate layer over the substrate; and an outermost layer over the intermediate layer; wherein at least one of the intermediate layer and the outermost layer comprises a healing material encapsulated within nano- or micro-capsules, wherein the healing material is capable of retaining the function of the imaging fixing member.

13 Claims, 2 Drawing Sheets

U.S. PATENT DOCUMENTS

| | | | |
|---|---|---|---|
| 5,935,712 | A | 8/1999 | Tan et al. |
| 5,991,590 | A | 11/1999 | Chang et al. |
| 5,998,033 | A | 12/1999 | Tan et al. |
| 6,007,657 | A | 12/1999 | Eddy et al. |
| 6,090,491 | A | 7/2000 | Tan et al. |
| 6,114,041 | A | 9/2000 | Tan et al. |
| 6,159,588 | A | 12/2000 | Eddy et al. |
| 6,197,989 | B1 | 3/2001 | Furukawa et al. |
| 6,253,055 | B1 | 6/2001 | Badesha et al. |
| 6,377,774 | B1 | 4/2002 | Maul et al. |
| 6,395,444 | B1 | 5/2002 | Riehle et al. |
| 6,676,996 | B2 * | 1/2004 | Pickering et al. ..... 427/365 |
| 7,108,914 | B2 * | 9/2006 | Skipor et al. ..... 428/402.21 |
| 2005/0111891 | A1 * | 5/2005 | Chen et al. ..... 399/328 |
| 2007/0282059 | A1 * | 12/2007 | Keller et al. ..... 524/588 |

OTHER PUBLICATIONS

White et al, Automatic Healing of Polymer Composites, 2001, Nature, vol. 409, 794-797.*

U.S. Appl. No. 12/041,173, filed Mar. 3, 2008, to De Jong et al.

U.S. Appl. No. 12/042,112, filed Mar. 4, 2008, to De Jong et al.

* cited by examiner

SELF-HEALING FUSER AND FIXING MEMBERS

This disclosure relates to (user or fixing members, and processes for making such fuser and fixing members. In particular, this disclosure relates to processes for making such fuser and fixing members, or other members, where at least a layer of the member includes a composition that is capable of self-healing. This disclosure also relates to processes for making and using the fusing and fixing members and electrostatographic printing apparatuses using such fusing and fixing members.

REFERENCES

U.S. Pat. No. 4,257,699 to Lentz, discloses a fuser member comprising at least one outer layer of an elastomer containing a metal-containing filler and use of a polymeric release agent.

U.S. Pat. No. 4,264,181 to Lentz et al., discloses a fuser member having an elastomer surface layer containing metal-containing filler therein and use of a polymeric release agent.

U.S. Pat. No. 4,272,179 to Seanor, discloses a fuser member having an elastomer surface with a metal-containing filler therein and use of a mercapto-functional polyorganosiloxane release agent.

U.S. Pat. No. 5,401,570 to Heeks et al., discloses a fuser member comprised of a substrate and thereover a silicone rubber surface layer containing a filler component, wherein the filler component is reacted with a silicone hydride release oil.

U.S. Pat. No. 4,515,884 to Field et al., discloses a fuser member having a silicone elastomer-fusing surface, which is coated with a toner release agent, which includes an unblended polydimethyl siloxane.

U.S. Pat. No. 5,512,409 to Henry et al. teaches a method of fusing thermoplastic resin toner images to a substrate using amino functional silicone oil over a hydrofluoroelastomer fuser member.

U.S. Pat. No. 5,516,361 to Chow et al. teaches a fusing member having a thermally stable FKM hydrofluoroelastomer surface and having a polyorgano T-type amino functional oil release agent. The oil has predominantly monoamino functionality per active molecule to interact with the hydrofluoroelastomer surface.

U.S. Pat. No. 6,253,055 to Badesha et al. discloses a (user member coated with a hydride release oil.

U.S. Pat. No. 5,991,590 to Chang et al. discloses a (user member having a low surface energy release agent outermost layer.

U.S. Pat. No. 6,377,774 B1 to Maul et al. discloses an oil web system.

U.S. Pat. No. 6,197,989 B1 to Furukawa et al. discloses a fluorine-containing organic silicone compound represented by a formula.

U.S. Pat. No. 5,757,214 to Kato et al. discloses a method for forming color images by applying a compound which contains a fluorine atoms and/or silicon atom to the surface of electrophotographic light-sensitive elements.

U.S. Pat. No. 5,716,747 to Uneme et al. discloses a fluororesin coated fixing device with a coating of a fluorine containing silicone oil.

U.S. Pat. No. 5,698,320 to Ebisu et al. discloses a fixing device coated with a fluororesin, and having a fluorosilicone polymer release agent.

U.S. Pat. No. 5,641,603 to Yamazaki et al. discloses a fixing method using a silicone oil coated on the surface of a heat member.

U.S. Pat. No. 5,636,012 to Uneme et al, discloses a fixing device having a fluororesin layer surface, and using a fluorine-containing silicone oil as a repellant oil.

U.S. Pat. No. 5,627,000 to Yamazaki et al. discloses a fixing method having a silicone oil coated on the surface of the heat member, wherein the silicone oil is a fluorine-containing silicone oil and has a specific formula.

U.S. Pat. No. 5,624,780 to Nishimori et al. discloses a fixing member having a fluorine-containing silicone oil coated thereon, wherein the silicone oil has a specific formula.

U.S. Pat. No. 5,568,239 to Furukawa et al. discloses a stainproofing oil for heat fixing, wherein the fluorine-containing oil has a specific formula.

U.S. Pat. No. 5,463,009 to Okada et al. discloses a fluorine-modified silicone compound having a specific formula, wherein the compound can be used for oil-repellancy in cosmetics.

U.S. Pat. No. 4,968,766 to Kendziorski discloses a fluorosilicone polymer for coating compositions for longer bath life.

The disclosures of each of the foregoing patents and publications are hereby incorporated by reference herein in their entireties. The appropriate components and process aspects of the each of the foregoing patents and publications may also be selected for the present compositions and processes in embodiments thereof.

BACKGROUND

In a typical electrostatographic printing apparatus, a light image of an original to be copied is recorded in the fonts of an electrostatic latent image upon a photosensitive member and the latent image is subsequently rendered visible by the application of electroscopic thermoplastic resin particles, which are commonly referred to as toner. The visible toner image is then in a loose powdered form and can be easily disturbed or destroyed. The toner image is usually fixed or fused upon a support, which may be a photosensitive member itself or other support sheet such as plain paper, transparency, specialty coated paper, or the like.

The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, thermoplastic resin particles are fused to the substrate by heating to a temperature of between about 90° C. to about 160° C. or higher, depending upon the softening range of the particular resin used in the toner. It is not desirable, however, to raise the temperature of the substrate substantially higher than about 200° C. because of the tendency of the substrate to discolor at such elevated temperatures particularly when the substrate is paper.

Several approaches to thermal fusing of electroscopic toner images have been described in the prior art. These methods include providing the application of heat and pressure substantially concurrently by various means, including a roll pair maintained in pressure contact, a belt member in pressure contact with a roll, and the like. Heat may be applied by heating one or both of the rolls, plate members or belt members. The fusing of the toner particles generally takes place when the proper combination of heat, pressure and contact time are provided. The balancing of these parameters to bring about the fusing of the toner particles is well known in the art, and they can be adjusted to suit particular machines, process conditions, and printing substrates.

Generally, fuser and fixing rolls are prepared by applying one or more layers to a suitable substrate. For example, cylindrical fuser and fixer rolls are typically prepared by applying an elastomer or a fluoroelastomer layer, with or without additional layers, to an aluminum core. The coated roll is then heated in a convection oven to cure the elastomer or fluoroelastomer material. Such processing is disclosed in, for example, U.S. Pat. Nos. 5,501,881, 5,512,409 and 5,729,813, the entire disclosures of which are incorporated herein by reference.

In use, important properties of the fuser or fixing members include thermal conductivity and mechanical properties such as hardness. Thermal conductivity is important because the fuser or fixer member must adequately conduct heat to provide the heat to the toner particles for fusing. Mechanical properties of the fuser or fixer member are important because the member must retain its desired rigidity and elasticity, without being degraded in a short period of time. However, increasing the loading of the filler tends to adversely affect mechanical properties of the coating layer, making the member harder and more prone to wear. For example, conventional metal oxides such as aluminum, iron, copper, tin, and zinc oxides may be used as fillers and are disclosed in U.S. Pat. Nos. 6,395,444, 6,159,588, 6,114,041, 6,090,491, 6,007,657, 5,998,033, 5,935,712, 5,679,463, and 5,729,813. These metal oxide filler materials, at loadings up to about 60 wt %, provide thermal conductivities of from about 0.2 to about 1.0 $Wm^{-1}K^{-1}$. However, as mentioned above, the loading amount of the filler must be limited due to the increased hardness provided by high loading levels.

Although excellent toner images may be obtained with fuser and fixing roils and members, it has been found that as more advanced, higher speed electrophotographic copiers, duplicators, and printers are developed, there is a greater demand on print quality. Improved fixing member designs must target higher sensitivity, faster discharge, mechanical robustness, and ease of fabrication. The delicate balance in charging image and bias potentials, and characteristics of the toner and/or developer must also be maintained. This places additional constraints on the quality of fixing and fuser member manufacturing, and thus on the manufacturing yield. Fusing and fixing members are generally exposed to repetitive electrophotographic cycling, which subjects the exposed layer to mechanical abrasion, chemical attack and heat. This repetitive cycling leads to gradual deterioration in the mechanical and electrical characteristics of the affected layer(s), and often results in the formation of microcracks. In particular, structural polymers are susceptible to the formation of such cracks and/or microcracks, which often form at a depth within the structure such that detection and repair are impossible. Once such cracks have developed, they may significantly and permanently compromise the functionality of the fusing or fixing member.

Permanent damage to the fuser roll by contact with paper edges remains a major concern that leads to premature failure of the fuser roll. The replacement costs associated with failed fuser rolls is extremely high, and thus improving fuser roll lifespan will result in significant cost-savings.

Accordingly, there is a need in the art for improved fixing members that will respond to and correct material breakdown as it occurs. Thus, in an effort to extend the life of fixing member components to the lifetime of the machine, devices having the ability to respond to their environment and that are self-healing when damage occurs are desired. Such devices would eliminate the need to maintain the machine by either the customer or a technician. There is also a need for improved materials that will not hinder thermal conductivity, but of a type or at loading levels that provide lower hardness to the member and that improve other desirable mechanical properties of the member, such as extended performance. This disclosure is thus directed to a fuser roll that is capable of self-healing. One such method of achieving self-healing, for example, involves the incorporation of healing material in a layer of the fuser roll. Such healing materials may, for example, be encapsulated in microcapsules such that, in the event of wear or scratching of the fuser roll, the capsules rupture, thereby releasing the healing material, which then may react with an embedded catalyst, causing polymerization and damage repair or damage control.

Despite the various approaches that have been taken for forming fusing and fixing members there remains a need for improved fusing and fixing member design, to provide improved imaging performance and longer lifetime, reduce the need for maintenance, and the like.

SUMMARY

This disclosure addresses some or all of the above described problems and also provides materials and methods for improved releasing performance, retained mechanical properties, fixing mechanical damages, thus improved imaging quality, longer lifetime, and the like of electrophotographic fixing members. This is generally accomplished by providing a fuser member or image fixing member comprising a self-healing material. Self healing as described herein refers to, for example, the ability of a material to retain the desired function and properties of the imaging fixing member, such as mechanical properties and releasing performance, regenerate or repair itself in the event that microcracks, voids, or the like are formed, through a chemical reaction or polymerization. This disclosure also relates to processes for making and using the fusing and fixing members.

More particularly, in embodiments, the present disclosure provides an image fixing member, comprising:

a substrate;

an optional intermediate layer over said substrate; and an outermost layer over said intermediate layer;

wherein at least one of the intermediate layer and the outermost layer comprises a healing material encapsulated within nano- or micro-capsules, wherein said healing material is capable of retaining the function of the imaging fixing member.

In embodiments, the present disclosure also provides a process for forming an image fixing member, comprising:

applying an outermost layer, and optionally an intermediate layer, over a substrate;

wherein at least one of the intermediate layer and the outermost layer comprises a healing material encapsulated within nano- or micro-capsules, wherein said healing material is capable of retaining the function of the imaging fixing member.

BRIEF DESCRIPTION OF THE DRAWINGS

These and other advantages and features of this disclosure will be apparent from the following, especially when considered with the accompanying drawing, in winch.

DETAILED DESCRIPTION OF PREFERRED EMBODIMENTS

According to embodiments, fusing and fixing members, and the like, are provided. In embodiments, the various members are made according to any of the various known processes in the art, except that self-healing materials are incorporated into the member, in place of or in conjunction with conventional filler materials.

Figure 1:
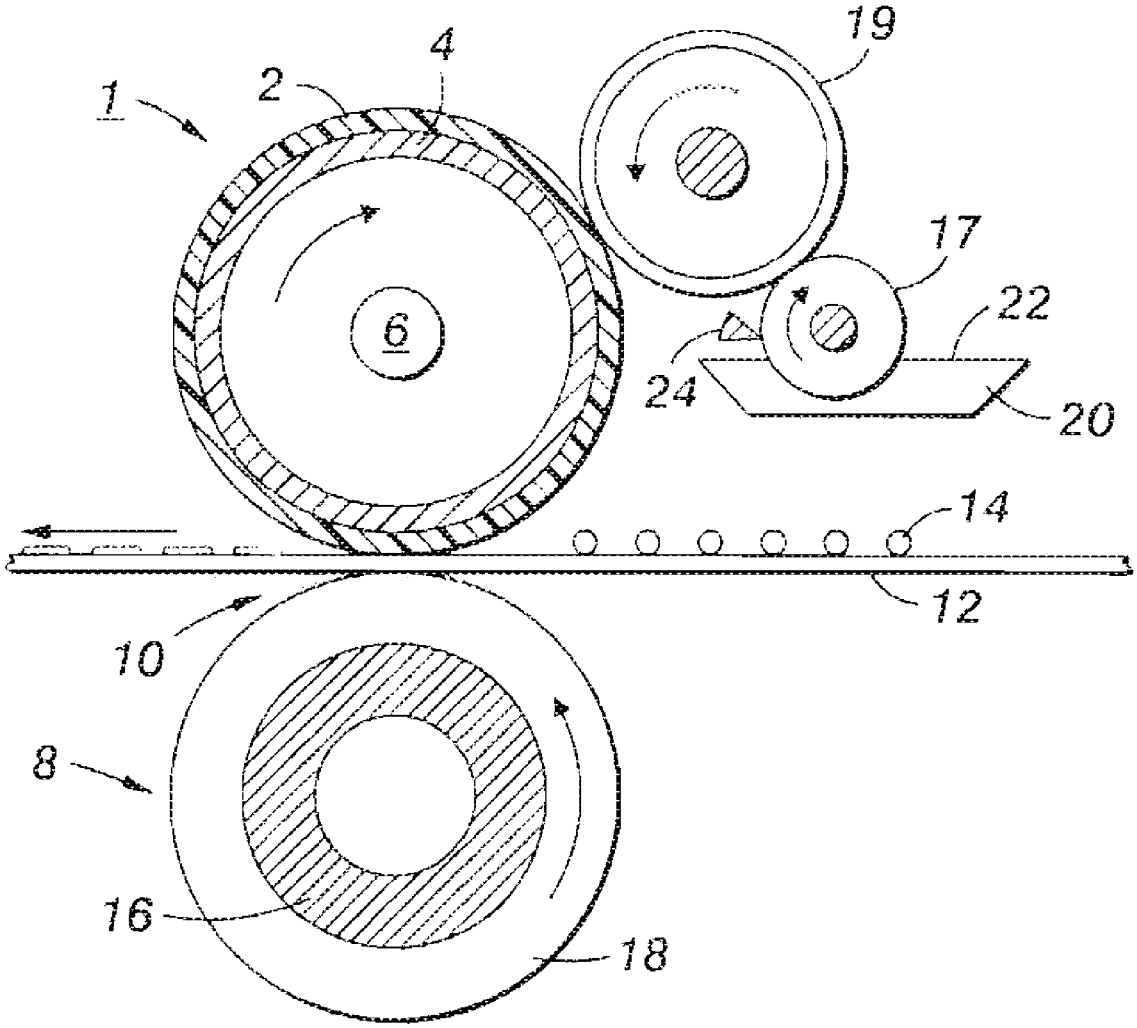
FIG. 1 is a sectional view of a fuser system that may use a fuser member according to the present disclosure.

A typical fuser member, alternatively referred to herein as a fixing member, of embodiments is described in conjunction with a fuser assembly as shown in FIG. 1 where the numeral 1 designates a fuser roll comprising an outer surface 2 upon a suitable base member 4. The base member 4 can be a hollow cylinder or core fabricated from any suitable metal such as aluminum, anodized aluminum, steel, nickel, copper, and the like. Alternatively, the base member 4 can be a hollow cylinder or core fabricated from non-metallic materials, such as polymers or the like, or can be an endless belt (not shown) of similar construction. As shown in the Figure, the base member 4 has a suitable heating element 6 disposed in the hollow portion thereof and that is coextensive with the cylinder. Alternatively, an external heater may be used as the heating element (not shown in the figures). Backup or pressure roll 8 cooperates with the fuser roll 1 to form a nip or contact arc 10 through which a copy paper or other substrate 12 passes, such that toner images 14 on the copy paper or other substrate 12 contact the outer surface 2 of fuser roll 1. As shown in the Figure, the backup roll 8 has a rigid steel core or a rigid polymer substrate 16 with a soft surface layer 18 thereon, although the assembly is not limited thereto. To facilitate releasing performance of the toner image, a release agent 22 may be applied on the fuser surface from a delivery unit, such as Sump 20. The release agent 22, typically comprising a silicone oil, but not limited thereto, which may be a solid or liquid at room temperature, but is a fluid at operating temperatures. Specific releasing agent include a polydimethylsiloxane or its copolymer with an organic siloxane member selected from the group consisting of a 3-aminopropylmethylsiloxane, a 3-mercaptopropylmethylsiloxane, 3,3,3-trifluoropropylmethylsiloxane, and the like.

In the embodiment shown in FIG. 1 for applying the polymeric release agent 22 to outer surface 2, two release agent delivery roils 17 and 19 rotatably mounted in the direction indicated are provided to transport release agent 22 from the sump 20 to the fuser roll surface. As illustrated, roll 17 is partly immersed in the sump 20 and transports on its surface release agent from the sump to the delivery roll 19. By using a metering blade 24, a layer of polymeric release fluid can be applied initially to delivery roll 19 and subsequently to the outer surface 2 of the fuser roll 1 in controlled thickness ranging from submicrometer thickness to thickness of several micrometers of release fluid. Thus, by metering device 24 about 0.1 to 2 micrometers or greater thickness of release fluid can be applied to the surface of fuser roll 1.

Of course, it will be appreciated that the design illustrated in FIG. 1 is not limiting to the present disclosure. For example, other well known and after developed electrostatographic printing apparatuses can also accommodate and use the fuser and fixer members described herein. For example, some apparatus in embodiments does not require the application of release agent to the fuser roll surface, and thus the release agent components can be omitted. In other embodiments, the depicted cylindrical fuser roll can be replaced by an endless belt fuser member. In still other embodiments, the heating of the fuser member can be by methods other than a heating element disposed in the hollow portion thereof. For example, heating can be by an external heating element or an integral heating element, as desired. Other changes and modification will be apparent to those in the art.

As used herein, the term "fuser" or "fixing" member, and variants thereof, may be a roll, belt such as an endless belt, flat surface such as a sheet or plate, or other suitable shape used in the fixing of thermoplastic toner images to a suitable substrate. It may take the form of a fuser member, a pressure member or a release agent donor member desirably in the form of a cylindrical roll. Typically, the fuser member is made of a hollow cylindrical metal core, such as copper, aluminum, steel and the like, and has an outer layer of the selected elastomer or fluoroelastomer. Alternatively, the fuser member can be made of a polymer substrate, such as a polyimide, and the like, and can have an outer layer of the selected elastomer or fluoroelastomer. Typical materials having the appropriate thermal and mechanical properties for such layers include silicone elastomers, fluoroelastomers, EPDM (ethylene propylene hexadiene), and Teflon™ (i.e., polytetrafluoroethylene) such as Teflon PFA sleeved rollers.

In particular embodiments, in addition to the core member and the outer coating layer, the fuser or other members may also optionally include one or more thermally conductive intermediate layers between the substrate and the outer layer of the cured elastomer, if desired. Typical materials having the appropriate thermal and mechanical properties for such intermediate layers comprises cured silicone elastomers, fluoroelastomers, and the like, and a fillers selected from the group consisting of metals, metal oxide, silicon carbide, boron nitride, and the like. Further, a primer layer, an adhesive layer, may be included to improve the adhesion between layers.

In embodiments, the fuser member is comprised of a core, such as metals, with a coating, usually continuous, of a thermally conductive and resilient compressible material that preferably has a high thermomechanical strength. Various designs for fusing and fixing members are known in the art and are described in, for example, U.S. Pat. Nos. 4,373,239, 5,501,881, 5,512,409 and 5,729,813, the entire disclosures of which are incorporated herein by reference. Generally, the core can include any suitable supporting material, around or on which the subsequent layers are formed. Suitable core materials include, but are not limited to, metals such as aluminum, anodized aluminum, steel, nickel, copper, and the like. If desired, the core material can also be selected to be a polymeric material, such as polyamide, polyimide, polyether ether ketone, and the like, which can be optionally filled with fiber such as glass, and the like. The core or substrate may be rigid or flexible mechanically.

The outer layer coating, which is desirably of a thermally conductive and resilient compressible material, is then applied to the core member. The coating can be any suitable material including, but not limited to, any suitable thermally conductive fluoropolymer, elastomer, or silicone material. Generally, the coating material must be a heat stable elastomer or resin material that can withstand elevated temperatures generally from about 90° C. up to about 200° C. or higher, depending upon the temperature desired for fusing or fixing the toner particles to the substrate. The coating material used in the fuser or fixing member must also generally not be degraded by any release agent that may be applied to the member, which is used to promote release of the molten or tackified toner from the member surface.

Suitable fluoropolymers include fluoroelastomers and fluororesins. Examples of suitable fluoroelastomers include, but are not limited to, i) copolymers of vinylidenefluoride and hexafluoropropylene; ii) terpolymers of vinylidenefluoride, hexafluoropropylene and tetrafluoroethylene; and iii) tetrapolymers of vinylidenefluoride, hexafluoropropylene, tetrafluoroethylene and a cure site monomer. For example, specifically, suitable fluoropolymers are those described in detail in U.S. Pat. Nos. 5,166,031, 5,281,506, 5,366,772, 5,370,931, 4,257,699, 5,017,432 and 5,061,965, the entire disclosures each of which are incorporated by reference herein in their entirety. As described therein these fluoropolymers, particularly from the class of copolymers of vinylidenefluoride and hexafluoropropylene; terpolymers of vinylidenefluoride, hexafluoropropylene and tetrafluoroethylene; and tetrapolymers of vinylidenefluoride, hexafluoropropylene, tetrafluoroethylene and cure site monomer, are known commercially under various designations as VITON A®, VITON E®, VITON E 60C®, VITON E430®, VITON 910®, VITON GH® and VITON GF®. The VITON® designation is a Trademark of E.I. DuPont de Nemours, Inc. The cure site monomer can be, for example, 4-bromoperfluorobutene-1,1,1-dihydro-4-bromoperfluorobutene-1,3-bromoperfluoropropne-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS® a poly (propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, and TN505®, available from Montedison Specialty Chemical Company.

Other fluoropolymers useful in the present disclosure include polytetrafluoroethylene (PTFE), fluorinated ethylenepropylene copolymer (FEP), polyfluoroalkoxypolytetrafluoroethylene (PFA Teflon) and the like.

Particularly suitable fluoropolymers useful for the surface of fuser members in the present disclosure include fluoroelastomers, such as fluoroelastomers of vinylidenefluoride based fluoroelastomers, which contain hexafluoropropylene and tetrafluoroethylene as comonomers. Three known fluoroelastomers are (1) a class of copolymers of vinylidenefluoride and hexafluoropropylene known commercially as VITON A® (2) a class of terpolymers of vinylidenefluoride, hexafluoropropylene and tetrafluoroethylene known commercially as VITON B® and (3) a class of tetrapolymers of vinylidenefluoride, hexafluoropropylene, tetrafluoroethylene and cure site monomer known commercially as VITON GH® or VITON GF®. VITON A®, VITON B®, VITON GH®, VITON GF® and other VITON® designations are trademarks of E.I. DuPont de Nemours and Company. The fluoroelastomers VITON GH® and VITON GF® available from E.I. DuPont de Nemours Inc., have relatively low amounts of vinylidenefluoride. The VITON GF® and Viton GH® have 35 weight percent of vinylidenefluoride, 34 weight percent of hexafluoropropylene and 29 weight percent of tetrafluoroethylene with 2 weight percent cure site monomer. In a further embodiment, the fluoropolymer is PFA Teflon, FEP, PTFE, VITON GF® or VITON GH®. In another embodiment, the fluoropolymer is PFA Teflon, VITON GF® or VITON GH®.

The coating can be applied to the core member by any suitable method known in the art. Such methods include, but are not limited to, spraying, dipping, flow coating, casting or molding. Typically the surface layer of the fuser member is from about 4 to about 9 mils, such as about 6 mils in thickness, as a balance between conform ability and cost and to provide thickness manufacturing latitude. Of course, other thickness layers can also be used.

In embodiments, the fuser or fixing members may also optionally include one or more thermally conductive intermediate layers between the substrate and the outer layer, if desired. Such intermediate layer may comprise a suitable elastomer material and a inorganic filler layer to achieve desired thermal conductivity. Examples of suitable elastomer materials include, but are not limited to, organic rubbers such as ethylene/propylene diene, fortified organic rubbers that resist degradation at fusing temperatures, various copolymers, block copolymers, copolymer and elastomer blends, and the like. Any elastomer or resin desirably has thermal oxidative stability, i.e., resist thermal degradation at the operating temperature of the fuser member. Thus the organic rubbers that resist degradation at the operating temperature of the fuser member may be used. These include chloroprene rubber, nitrile rubber, chlorobutyl rubber, ethylene propylene terpolymer rubber (EPDM), butadiene rubber, ethylene propylene rubber, butyl rubber, butadiene/acrylonitrile rubber, ethylene acrylic rubber, styrene/butadiene rubber, and the like or the foregoing rubbers fortified with additives that thermally stabilize the rubber at least at the operating temperature of the fuser member.

Examples of elastomer materials suitable for the intermediate layer include, but are not limited to, silicone rubber, fluorosilicones, siloxanes, and the like. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; and 106 RTV Silicone Rubber and 90 RTV Silicone Rubber, both from General Electric. Further examples of silicone materials include Dow Corning SILASTIC® 590 and 591, Sylgard 182, and Dow Corning 806A Resin. Other silicone materials include fluorosilicones such as nonylfluorohexyl and fluorosiloxanes such as DC94003 and Q5-8601, both available from Dow Corning. Silicone conformable coatings such as X3-6765 available from Dow Corning can be used. Other suitable silicone materials include the siloxanes (such as polydimethylsiloxanes) such as, fluorosilicones, dimethylsilicones, liquid silicone rubbers such as vinyl crosslinked heat curable rubbers or silanol room temperature crosslinked materials, and the like. Suitable silicone rubbers are available also from, for example, Wacker Silicones, Dow Corning, GE Silicones, and Shin-Etsu.

Typical materials having the appropriate thermal and mechanical properties for such intermediate layers include thermally conductive (e.g., 0.59 $Wm^{-1}K^{-1}$) silicone elastomers such as high temperature vulcanizable ("HTV") materials, liquid silicone rubbers ("LSR") and room temperature vulcanizable ("RTV"), which may optionally include filler materials. Illustrative examples of fillers include metal oxide such as alumina, silica, silicon carbide, boron nitride, and the like. The silicone elastomer may have a thickness of about 2 to 10 mm (radius). An HTV is either a plain polydimethyl siloxane ("PDMS"), with only methyl substituents on the chain, ($OSi(CH_3)_2$) or a similar material with some vinyl groups on the chain ($OSi(CH{=}CH_2)(CH_3)$). Either material is peroxide cured to create crosslinking. An LSR usually consists of two types of PDMS chains, one with some vinyl substituents and the other with some hydride substituents. They are kept separate until they are mixed just prior to molding. A catalyst in one of the components leads to the addition of the hydride group ($OSiH(CH_3)$) in one type of chain to the vinyl group in the other type of chain causing crosslinking.

An adhesive layer may be further included to promote adhesion between the layers of the fuser member, such as the layer between the core substrate and the outer layer, the layer between the core substrate and the intermediate layer, or the layer between the intermediate layer and the outer layer. Suitable adhesive layer may comprise, but not limited to, a silane coupling agent. For example, the fuser member core and the fluoroelastomer surface layer, may include an adhesive, and in particular a silane adhesive, such as described in U.S. Pat. No. 5,049,444, the entire disclosure of which is incorporated herein by reference, which includes a copolymer of vinylidenefluoride, hexafluoropropylene and at least 20 percent by weight of a coupling agent that comprises at least one organo functional silane and an activator, may be used. In addition, for the higher molecular weight hydrofluoroelastomers such as, for example, Viton GF, the adhesive may be formed from the FKM hydrofluoroelastomer in a solvent solution together with an amino silane represented by the formula as described in U.S. Pat. No. 5,332,641, the entire disclosure of which is incorporated herein by reference.

Once the desired layers are applied to the core member, the elastomer materials are cured. Any of the various curing methods known in the art can be used, such as convection oven drying, radiant heat drying, and the like.

In embodiments, the fuser member or image fixing member described herein comprises a composite coating layer containing a self-healing material. Self healing as described herein refers to, for example, the ability of a material to retain the desired junction and properties of the imaging fixing member, such as mechanical properties and releasing performance, regenerate or repair itself in the event that microcracks, voids, or the like are formed, through a chemical reaction or polymerization. Any suitable material may be incorporated into the desired layer of the fuser member to provide self-healing capabilities. Such materials may thereby provide the layer with the ability to self-heal, for example, upon activation of the materials by mechanical stress or the like. For example, a self-healing material incorporated in the outer layer may offer advantages, such as self-releasing feature to mitigate contamination from residual toners, fixing microcracks due to structural failure, and the like. In an another example, a self-healing material incorporated in the intermediate layer may offer advantages, such as retaining mechanical properties by preventing compression fatigue due to mechanical and therma stress, fixing voids or microcracks due to structural failure, and the like. Therefore, self-healing materials and properties are beneficial in extending the life of the fuer or fixing member, improving image quality, and reducing the need for maintenance.

In embodiments, the self-healing materials may include monomers, oligomers, or prepolymers, which, when activated, are capable of forming a material with higher mechanical strength and desired performance properties as described above. To avoid adverse impact on the fabrication or the performance of the fuser member, the healing materials described herein are typically contained within nano- or micro-capsules. The capsules filled with healing materials are dispersed in the fuser composite layer. When triggered by mechanical stress, such as pressure or a crack in the fuser member coating, some of the capsules rupture, and deliver the healing materials to repair the layer of the fuser member by forming a polymer with higher mechanical strength and desired performance properties. To facilitate the healing process, an initiator or a catalyst may be included to activate or accelerate the chemical reaction or polymerization of the healing materials. The catalyst may be distributed within the entire fuser member coating. In another manner, the catalyst can be embedded on the surface of the capsules.

Figure 2:
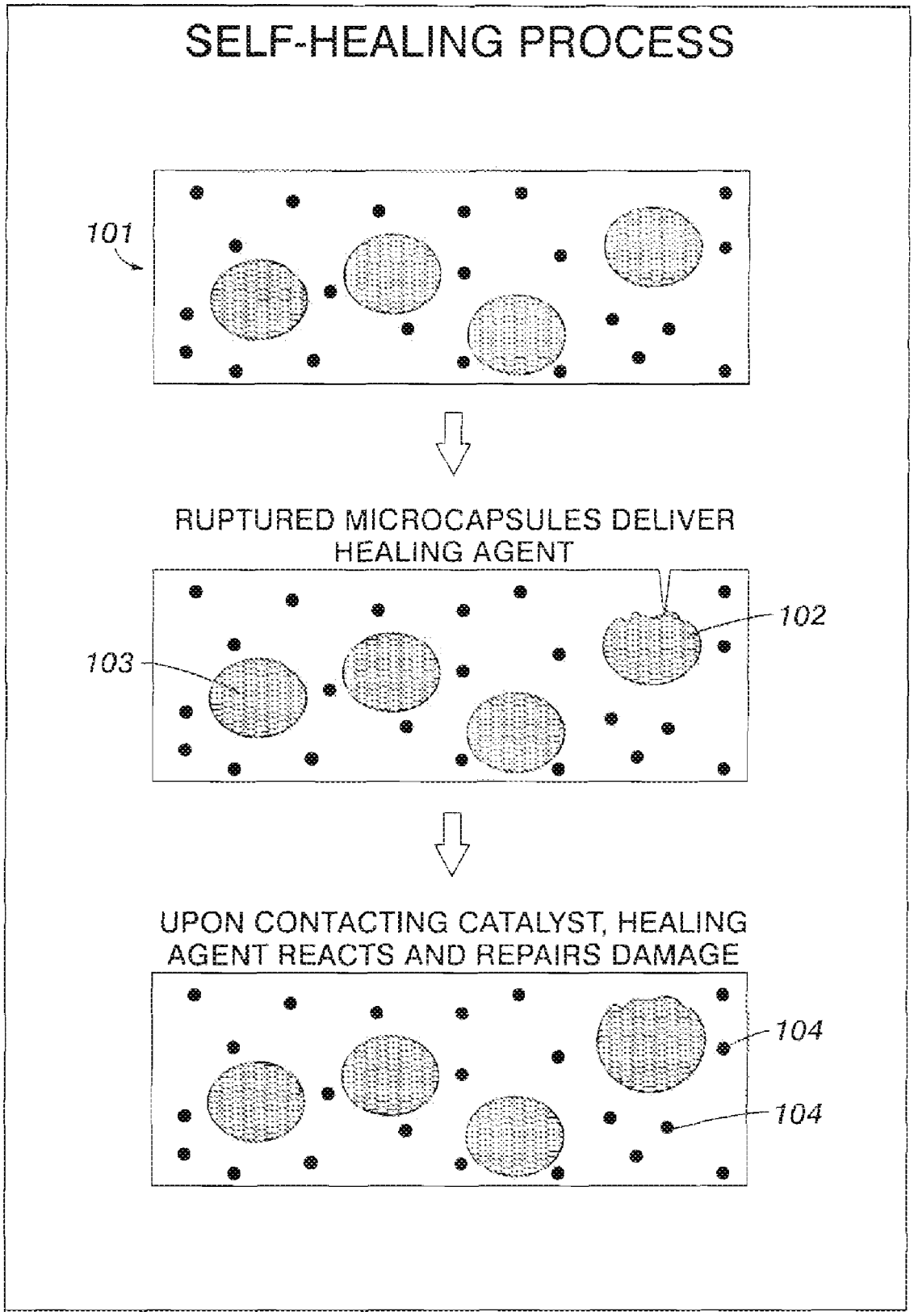
FIG. 2 is an illustration of self-healing processes of an Example of the disclosure.

In embodiments, any layer of the fuser member may comprise a self-healing material that is encapsulated in microcapsules. For example, the outer layer of the fuser member may comprise a self-healing material that is encapsulated in nano- or microcapsules; the intermediate layer of the fuser member may comprise a self-healing material that is encapsulated in nano- or microcapsules. If desired, both the outer layer and the intermediate layer may comprise a healing material that is encapsulated in nano- or microcapsules. Nano- or microcapsules not only store the self-healing material during quiescent states, but provide a mechanical trigger for the self-healing process when damage occurs in the host material and the capsules rupture. For example, as seen in the FIG. 2, in the event of pressure with a pressure roil or wear of the fuser 101, the capsules 103 may be forced to rupture, thereby releasing the self-healing material 102, which can react with host polymer matrix. Alternatively, the released healing material react with itself by activation in the present of a catalyst 104 embedded in the layer of the fuser 101.

Optionally, a catalyst or other compound capable of reacting with the self healing materials may also be present. Such a catalyst or other compound may be, for example, embedded in a layer of the fuser, embedded on the surface of the capsule, or encapsulated in nano- or microcapsules. In embodiments, when triggered by mechanical stress or cracking, the capsules may thus be designed to release the healing material which then reacts with an embedded catalyst causing the polymerization reaction. Such a chemical reaction or polymerization reaction may result in regaining desired function or repairing damage of the cracked portion of the fuser. Alternatively, in embodiments, when the catalyst can optionally be encapsulated in nano- or microcapsules. Thus, when the capsule ruptures, catalyst may be released and may then react with self-healing material.

In embodiments, healing materials may perform a chemical reaction or polymerization with itself or with the host matrix polymers. Suitable healing materials include, but not limited to: i) amino-functional polysiloxane prepolymers capable of reacting with Viton-type fluoroelastomers; metal oxide catalyst may be employed to facilitate healing effect; and ii) silane grafted fluoroelatomers; metal oxide or moisture may be employed to facilitate healing effect; iii) vinyl-functional polysiloxanes prepolymers capable of curing reaction; radical initiator compound may be employed to facilitate healing effect; and iv) Vulcanizable silicone prepolymers, such as vinyl-containing polysiloxanes and hydrosiloxane-containing polysiloxanes, and the like; hydrosilylation initiator or catalyst, such as platinum catalyst, may be employed to facilitate healing effect.

In particular embodiments, the healing materials may be incorporated into the outer layer comprised of fluoroelastomers in a fuser member. Suitable healing materials may include, but not limited to, a amino-functional siloxane prepolymer. When released, such materials are capable of reacting with host fluoropolymers. Illustrative examples of polysiloxane prepolymer, which may selected as healing materials, may be selected from the group consisting of

S-1

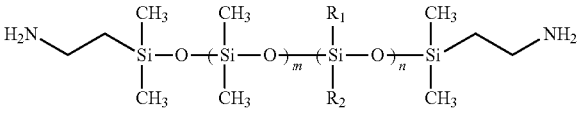

-continued

S-2

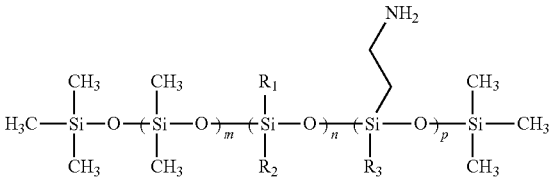

wherein $R_1$ and $R_2$ are each an substituent; m, n, and p, each represents the molar ratio of the polysiloxanes of the corresponding component. $R_1$ and $R_2$ may be selected from the group consisting of a hydrogen, an alkyl having from 1 to about 20 carbons, a fluoroalkyl having from 1 to about 20 carbons, an aryl having from about 6 to about 30 carbons, a fluoroaryl having from about 6 to about 30 carbons, and the like.

Specific examples of fluoroelastomer prepolymer, which may selected as healing materials for the outer layer coating of a fuser member, may be selected from the group consisting of a copolymers of vinylidenefluoride and hexafluoropropylene; a copolymer of vinylidenefluoride, hexafluoropropylene and tetrafluoroethylene; a copolymer of vinylidenefluoride, hexafluoropropylene and perfluoro(methyl vinyl ether); a fluorinated polyolefin, a fluorosilicone, and a perfluoropolyether, and a mixture thereof. The fluoroelastomer prepolymer may further comprises a reactive functional moiety selected from the group consisting of bromide, iodide, a vinyl, and a silane group. Illustrative examples of fluoroelastomer prepolymer possesses a reactive functional moiety consisting of

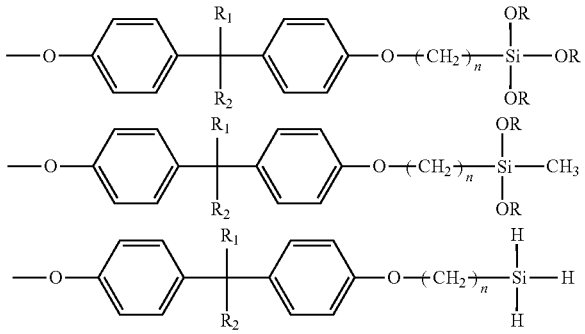

and a mixture thereof; wherein $R_1$ and $R_2$ are each an alkyl or a fluoroalkyl having from 1 to about 10 carbons, R is an alkyl having from 1 to about 6 carbons, and n is an integer of from 1 to about 10.

In such embodiments, rupture of the microcapsule results in release the grafted viton held inside the capsule, which may then polymerize with the matrix when exposed to moisture and heat.

viton

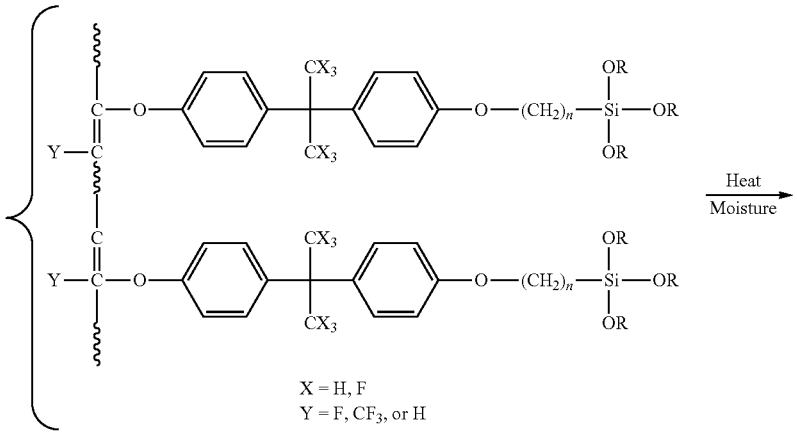

X = H, F
Y = F, $CF_3$, or H

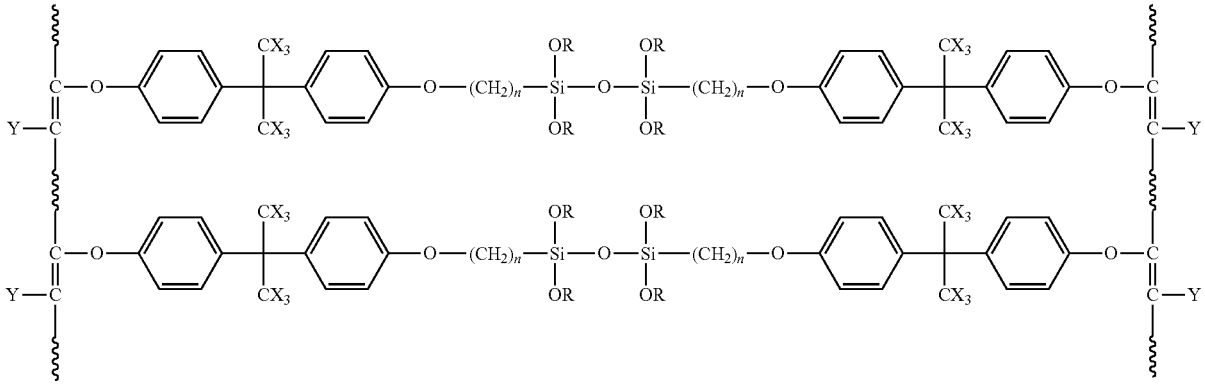

X = H, F
Y = F, $CF_3$, or H

In additional embodiments, the healing materials may be incorporated into the intermediate layer comprised of silicone elastomers in a fuser member. Suitable healing materials may include, but not limited to, vinyl-functional polysiloxane prepolymers capable of curing reaction in the presence of a radical initiator compound. Illustrative examples of vinyl-functional polysiloxanes may selected from the group consisting of

S-3

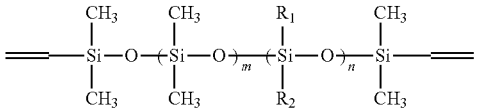

S-4

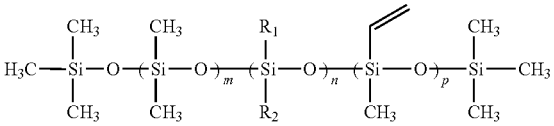

S-5

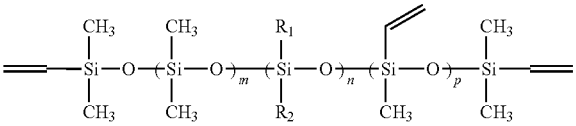

and mixture thereof; wherein $R_1$, $R_2$ and $R_3$ are each a substituent selected from the group consisting of a hydrogen, an alkyl having from 1 to about 20 carbons, a fluoroalkyl having from 1 to about 20 carbons, an aryl having from about 6 to about 30 carbons, a fluoroaryl having from about 6 to about 30 carbons, wherein m, n, and p each represents the molar ratio of the corresponding component.

In addition, silicone prepolymer, which may selected as healing materials for the intermediate layer coating of a fuser member, may comprise Vulcanizable silicone prepolymers comprised of a mixture of vinyl-containing polysiloxanes and hydrosiloxane-containing polysiloxanes, and the like. Hydrosilylation initiator or catalyst, such as platinum catalyst, may be employed to facilitate healing effect. Illustrative examples of such polysiloxane prepolymer may be selected from the group consisting of

S-3

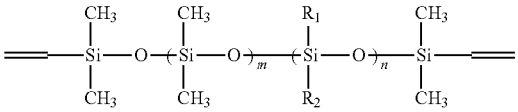

S-4

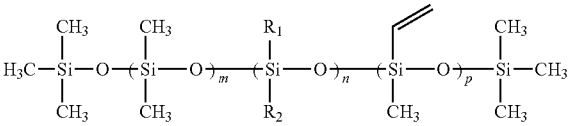

S-5

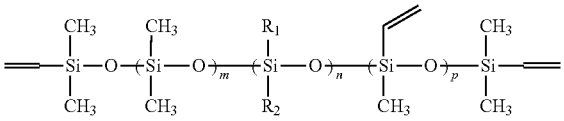

-continued

S-6

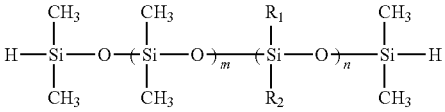

S-7

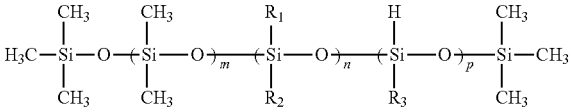

S-8

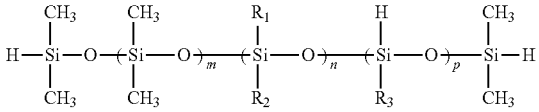

and mixture thereof; wherein $R_1$, $R_2$ and $R_3$ are each a substituent selected from the group consisting of a hydrogen, an alkyl having from 1 to about 20 carbons, a fluoroalkyl having from 1 to about 20 carbons, an aryl having from about 6 to about 30 carbons, a fluoroaryl having from about 6 to about 30 carbons, wherein m, n, and p each represents the molar ratio of the corresponding component.

Nano- or microcapsule diameter and surface morphology may significantly affect capsule rupture behavior. The microcapsules may possess sufficient strength to remain intact during processing, yet rupture when triggered by mechanical stress. In embodiments, the microcapsules may exhibit high bond strength to the fuser coating materials, combined with a moderate strength microcapsule shell. In embodiments, the capsules may be impervious to leakage and diffusion of the encapsulated (liquid) healing material for considerable time in order to, for example, extend shelf life. In embodiments, these combined characteristics can be achieved, for example, with a system based on capsules with a suitable wall comprised of urea-formaldehyde resins, melamine formaldehyde resins, polyesters, polyurethanes, polyamides and the like.

There is significant scientific and patent literature on encapsulation techniques and processes. For example, microencapsulation is discussed in detail in "Microcapsule Processing and Technology" by Asaji Kondo, 1979, Marcel Dekker, Inc; "Microcapsules and Microencapsulation Techniques by Nuyes Data Corp., Park Ridge, N.J. 1976, Illustrative encapsulation includes chemical processes such as interfacial polymerization, in-situ polymerization, and matrix polymerization, and physical processes, such as centrifugal extrusion, phase separation, and core-shell encapsulation by vibration, and the like. Materials may be used for interfacial polymerization include, but not limited to, diacyl chlorides or isocyanates, in combination with di- or poly-alcohols, amines, polyester polyols, polyurea, and polyurethans. Useful materials for in situ polymerization include, but not limited to, polyhydroxyamides, with aldehydes, melamine, or urea and formaldehyde, and the like.

In embodiments, the microcapsules are substantially spherical in shape and may have an average diameter of from 20 nanometers to about 250 nanometers, about 0.25 micrometer to about 5 micrometers, or from about 5 micrometers to about 20 micrometers. Microcapsules may comprise from about 70% to about 95% by weight of healing materials, such as from about 83% to about 92% by weight, or other fill material. Microcapsules may thus comprise about 5% to about 30% by weight of the total aggregate weight of the microcapsule and its fill content, such as from about 8% to about 17%, or from about 1% to about 10%. Microcapsule shell wail thickness may be from about 10 nm to about 250 nm, for example, from about 20 nm to about 200 nm. Microcapsules in this range of shell thickness may be sufficiently robust to survive handling and manufacture. Nanoparticles of the microcapsule material may form on the surface of the microcapsules during production, thereby producing a rough surface morphology. Rough surface morphology may, for example, enhance mechanical adhesion when the microcapsules are embedded in a polymer, thus improving performance as a lubrication mechanism.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

The microcapsules containing healing materials may be prepared by any conventional means or any other method obvious to those skilled in the art, such as by encapsulation via in situ polymerization in an oil-in-water emulsion. Self healing layers of fixing members can be prepared by any conventional means or any other method obvious to those skilled in the art which would produce the desired coating layer.

A fixing member incorporating microcapsules is prepared in accordance with the following procedure. A coated fuser roll is made by coating a layer of VITON rubber with AO700 curative (N-(2-aminoethyl)-3-aminopropyltrimethoxysilane, available from United Chemical Technologies, Inc.) on a metallic substrate. The fuser roll substrate is a cylindrical aluminum fuser roil core about 3 inches in diameter and 16 inches long, which is degreased, grit blasted, degreased and covered with a silane adhesive as described in U.S. Pat. No. 5,332,641, the entire disclosure of which is incorporated herein by reference. The elastomer layer is prepared from a solvent solution/dispersion containing Viton™ polymer and A0700 curative at a level from 2-10 pph in methyl isobutyl ketone. To this solution were added microcapsules comprising self-healing material of an amino-functional polydimethysiloxane oil at a level from 5-20 pph. The suspension solution is sprayed upon the 3 inch cylindrical roll to a nominal thickness of about 10-12 mils. The coated fuser member is then cured in a convection oven.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image fixing member, comprising:

a substrate;

an optional intermediate layer over said substrate; and an outermost layer over said substrate or over said optional intermediate layer when said intermediate layer is present;

wherein at least one of the optional intermediate layer when present and the outermost layer comprises a healing material encapsulated within nano- or micro-capsules, said healing material comprises a fluoroelastomer prepolymer selected from the group consisting of copolymers of vinylidenefluoride and hexafluoropropylene; a copolymer of vinylidenefluoride, hexafluoropropylene and tetrafluoroethylene; a copolymer of vinylidenefluoride, hexafluoropropylene and perfluoro(methyl vinyl ether); a fluorinated polyolefin, a fluorosilicone, and a perfluoropolyether, and a mixture thereof, and said fluoroelastomer prepolymer possesses a reactive functional moiety selected from the group consisting of

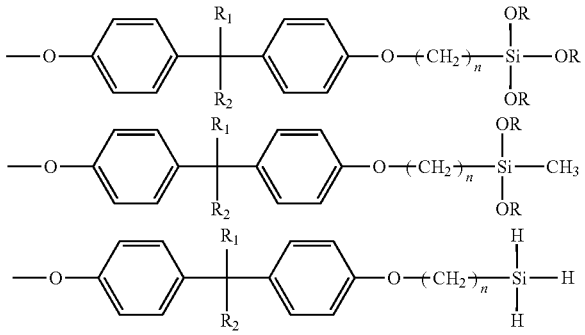

and mixtures thereof; wherein $R_1$ and $R_2$ are each an alkyl or a fluoroalkyl having from 1 to about 10 carbons, R is an alkyl having from 1 to about 6 carbons, and n is an integer of from 1 to about 10.

2. The image fixing member of claim 1, wherein the nano- or microcapsules comprise the healing material and a thin wall/shell, wherein said healing material is contained within the wall/shell.

3. The image fixing member of claim 2, wherein said thin wall/shell is comprised of a polymeric material selected from the group consisting of urea-formaldehyde resins, melamine formaldehyde resins, cured polyesters, and cured polyurethanes, and $SiO_2$ materials.

4. The image fixing member of claim 1, wherein said at least one of the optional intermediate layer when present and the outermost layer that comprises the healing material encapsulated within nano- or micro-capsules, further comprises a catalyst capable of accelerating a reaction of said healing material, and wherein the catalyst is present in a host polymer matrix or on a surface of the capsules.

5. The image fixing member of claim 4, wherein said catalyst comprises at least a member selected from the group consisting of a transition metal catalyst, a free radical initiator, and a metal oxide.

6. The image fixing member of claim 1, wherein said micro-capsules have an average diameter of from about 0.25 micrometer to about 25 micrometers; wherein said nanocapsules have an average diameter of about 20 nanometers to about 250 nanometers.

7. The image fixing member of claim 1, wherein said outermost layer comprises fluoropolymers or cured fluoropolymers.

8. The image fixing member of claim 7, wherein said fluoropolymer comprises a polymer or copolymer with at least a repeat unit selected from the group consisting of ethylene, vinylidenefluoride, hexafluoropropylene, tetrafluoroethylene, perfluoro(methyl vinyl ether), perfluoro(ethyl vinyl ether), perfluoro(propyl vinyl ether), and mixtures thereof.

9. The image fixing member of claim 1, wherein said intermediate layer is present and comprises cured silicone elastomers.

10. The image fixing member of claim 9, wherein the intermediate layer comprised of cured silicone elastomers has a thermal conductivity of at least about 0.3 $Wm^{-1}K^{-1}$ and a Shore A hardness of less than about 90.

11. The image fixing member of claim 1, wherein the outermost layer comprises the healing material encapsulated within nano- or micro-capsules.

12. The image fixing member of claim 1, wherein the substrate is in a form of a hollow cylinder, a belt or a sheet.

13. A process for forming an image fixing member, comprising:

applying an outermost layer, and optionally an intermediate layer, over a substrate such that the outermost layer is over said substrate or over said optional intermediate layer when said intermediate layer is present;

wherein at least one of the optional intermediate layer when present and the outermost layer comprises a healing material encapsulated within nano- or micro-capsules, said healing material comprises a fluoroelastomer prepolymer selected from the group consisting of copolymers of vinylidenefluoride and hexafluoropropylene; a copolymer of vinylidenefluoride, hexafluoropropylene and tetrafluoroethylene; a copolymer of vinylidenefluoride, hexafluoropropylene and perfluoro(methyl vinyl ether); a fluorinated polyolefin, a fluorosilicone, and a perfluoropolyether, and a mixture thereof, and said fluoroelastomer prepolymer possesses a reactive functional moiety selected from the group consisting of

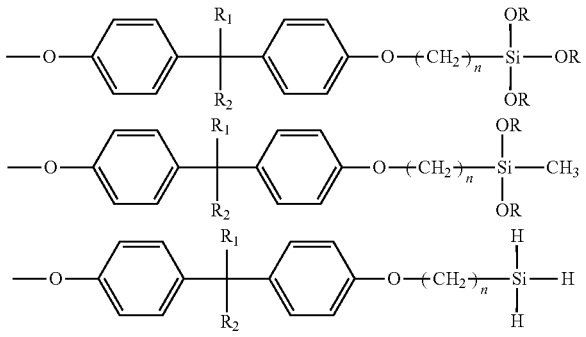

and mixtures thereof; wherein $R_1$ and $R_2$ are each an alkyl or a fluoroalkyl having from 1 to about 10 carbons, R is an alkyl having from 1 to about 6 carbons, and n is an integer of from 1 to about 10.

* * * * *